US009540842B2

(12) United States Patent
Storr

(10) Patent No.: US 9,540,842 B2
(45) Date of Patent: Jan. 10, 2017

(54) DOOR LATCH ASSEMBLY WITH MOVABLE LOCK PLATE

(75) Inventor: Walter K. Storr, North Wales, PA (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 13/189,098

(22) Filed: Jul. 22, 2011

(65) Prior Publication Data

US 2013/0020813 A1 Jan. 24, 2013

(51) Int. Cl.

| | |
|---|---|
| ***E05C 1/04*** | (2006.01) |
| ***E05B 15/02*** | (2006.01) |
| ***E05B 63/24*** | (2006.01) |
| ***E05B 65/08*** | (2006.01) |

(52) U.S. Cl.

CPC ..... *E05B 15/022* (2013.01); *E05B 63/244* (2013.01); *E05B 65/0811* (2013.01); *Y10T 292/1028* (2015.04)

(58) Field of Classification Search

CPC ..... Y10T 292/1028; E05B 15/022; E05B 63/244; E05B 65/0811; E05B 15/0093; E05B 2047/0075; E05B 2047/0078; E05B 65/5292; E05B 15/02; E05B 15/0205; E05B 15/021; E05B 15/0225; E05B 15/024; E05B 15/0245; E05B 15/025; E05B 15/0255; E05B 15/029; E05B 15/0295; E05B 17/02

USPC ..... 292/95, 150, 340, 341, 341.11–341.19,292/341.13, 341.15, 341.18, 183, 184, 230, 231,292/238

See application file for complete search history.

(56) References Cited

U.S. PATENT DOCUMENTS

| | | | | | |
|---|---|---|---|---|---|
| 633,918 | A | * | 9/1899 | Smith | 292/341.19 |
| 650,059 | A | * | 5/1900 | Almonte | 292/17 |
| 749,818 | A | * | 1/1904 | Hamel | 292/341.19 |
| 872,053 | A | * | 11/1907 | Christy | 292/341.18 |
| 882,296 | A | * | 3/1908 | Carroll | E05B 15/0093 292/108 |
| 922,675 | A | * | 5/1909 | Day | 70/100 |
| 1,059,530 | A | * | 4/1913 | Dupuis | 292/341.19 |
| 1,093,816 | A | * | 4/1914 | Wiley | 292/341.19 |
| 1,251,682 | A | * | 1/1918 | Miller | 292/341.16 |
| 1,265,351 | A | * | 5/1918 | Menier | 292/341.11 |
| 1,272,115 | A | * | 7/1918 | Russell | 292/341.19 |
| 1,318,382 | A | * | 10/1919 | Herby | 292/341.12 |
| 1,458,637 | A | * | 6/1923 | Anderson | 292/341.18 |
| 1,475,725 | A | * | 11/1923 | Steinmark | 292/150 |
| 1,479,744 | A | * | 1/1924 | Salata | 70/142 |
| 2,042,024 | A | * | 5/1936 | Schlage | 292/341.18 |
| 2,094,119 | A | * | 9/1937 | Flora | 292/341.19 |
| 2,231,414 | A | * | 2/1941 | Model | 292/341.18 |

(Continued)

FOREIGN PATENT DOCUMENTS

| | | | | | |
|---|---|---|---|---|---|
| GB | 2168747 | A | * | 6/1986 | E05B 15/02 |

*Primary Examiner* — Kristina Fulton
*Assistant Examiner* — Faria Ahmad
(74) *Attorney, Agent, or Firm* — Gardere Wynne Sewell LLP

(57) ABSTRACT

A latch assembly for a door comprising a bolt disposed on the door, the bolt movable between a locked position and an unlocked position. The latch assembly further includes a lock plate disposed on a door jamb, the lock plate movable between an upper position and a lower position. During operation, when the bolt is in the locked position, the bolt slideably engages the lock plate to move the lock plate from the lower position to an upper position to enable the bolt to be inserted within an opening in the lock plate to secure the door in a closed position.

14 Claims, 2 Drawing Sheets

(56) References Cited

U.S. PATENT DOCUMENTS

| | | | | | |
|---|---|---|---|---|---|
| 2,401,854 | A | * | 6/1946 | Berry, Jr. | 292/341.19 |
| 2,736,185 | A | * | 2/1956 | Collar | 70/100 |
| 2,793,894 | A | * | 5/1957 | Modes | 292/128 |
| 2,794,665 | A | * | 6/1957 | Reuben | 292/194 |
| 2,868,577 | A | * | 1/1959 | Zingone | 292/99 |
| 3,040,555 | A | * | 6/1962 | Wartian | 70/97 |
| 3,245,709 | A | * | 4/1966 | Rosenberger | 292/341.13 |
| 3,257,139 | A | * | 6/1966 | Russell et al. | 292/341.18 |
| 3,416,829 | A | * | 12/1968 | Russell et al. | 292/341.19 |
| 3,437,363 | A | * | 4/1969 | Walters | 292/113 |
| 3,437,364 | A | * | 4/1969 | Walters | 292/113 |
| 3,506,293 | A | * | 4/1970 | Armstrong et al. | 292/341.19 |
| 3,728,820 | A | * | 4/1973 | Lange | E05C 17/24 292/274 |
| 3,776,580 | A | * | 12/1973 | James | 292/17 |
| 3,826,526 | A | * | 7/1974 | Wepsala, Jr. | 292/346 |
| 4,113,293 | A | * | 9/1978 | Paquette | 292/341.18 |
| 4,138,151 | A | * | 2/1979 | Nakao | 292/76 |
| 4,181,338 | A | * | 1/1980 | Sterling | 292/341.17 |
| 4,288,120 | A | * | 9/1981 | Moore | 292/341.18 |
| 4,453,752 | A | * | 6/1984 | McKann | 292/341.19 |
| 4,480,862 | A | * | 11/1984 | Fleming | 292/162 |
| 4,580,820 | A | * | 4/1986 | Baber | 292/264 |
| 4,626,010 | A | * | 12/1986 | Hanchett et al. | 292/341.16 |
| 4,635,399 | A | * | 1/1987 | Gehrke et al. | 49/460 |
| 5,118,151 | A | * | 6/1992 | Nicholas et al. | 292/341.19 |
| 5,421,627 | A | * | 6/1995 | Yane | 292/162 |
| 5,469,606 | A | * | 11/1995 | Hansen | 24/662 |
| 5,542,720 | A | * | 8/1996 | Fleming | 292/32 |
| 5,573,287 | A | * | 11/1996 | Takimoto | 292/29 |
| 5,575,515 | A | * | 11/1996 | Iwamoto et al. | 292/341.17 |
| 5,595,409 | A | * | 1/1997 | Fier et al. | 292/112 |
| 5,757,269 | A | * | 5/1998 | Roth et al. | 340/542 |
| 6,082,787 | A | * | 7/2000 | Chioffi et al. | 292/128 |
| 7,261,330 | B1 | * | 8/2007 | Hauber | 292/97 |
| 7,373,794 | B1 | * | 5/2008 | DePass | 70/99 |
| 7,422,249 | B2 | * | 9/2008 | Glover | 292/199 |
| 8,272,169 | B2 | * | 9/2012 | Mahdi | 49/449 |
| 2002/0093208 | A1 | * | 7/2002 | McGregor et al. | 292/240 |
| 2006/0119108 | A1 | * | 6/2006 | Heid et al. | 292/97 |
| 2007/0040397 | A1 | * | 2/2007 | Nicholas et al. | 292/341.18 |
| 2007/0200370 | A1 | * | 8/2007 | Reithmeyer | 292/340 |
| 2008/0258481 | A1 | * | 10/2008 | Uyeda | 292/341.15 |
| 2010/0096864 | A1 | * | 4/2010 | Webb et al. | 292/341.16 |
| 2012/0192490 | A1 | | 8/2012 | McCaslin | |
| 2012/0192493 | A1 | * | 8/2012 | Wolfe | E05B 47/0046 49/449 |
| 2012/0286527 | A1 | * | 11/2012 | Mullet et al. | 292/341.18 |
| 2013/0020812 | A1 | * | 1/2013 | Snyder et al. | 292/145 |

* cited by examiner

DOOR LATCH ASSEMBLY WITH MOVABLE LOCK PLATE

BACKGROUND

Technical Field

The present invention relates to a door latch assembly for securing a door in a closed and/or otherwise locked position, and even more particularly, to a door latch assembly having movable latch plate for providing a smooth and quiet door closure when the door is transitioned to the closed position.

Introduction

In typical door installations, as the door is moved from an open position towards a closed position, a large force is oftentimes required to enable the door's bolt to lock into and otherwise engage a lock plate on the door jamb to secure the door in the closed position. Thus, in the case of a typical sliding door assembly, as the door is moved towards the closed position, an increased velocity/closing force is oftentimes required, especially with lightweight doors. This results in undesirable noise and/or large slamming forces against the door frame, potentially damaging the door or door frame. It is therefore the principal purpose of this invention to avoid these and other disadvantages of existing door latch assemblies.

SUMMARY

The door latch assembly disclosed herein utilizes a lock plate disposed on a door jamb that is movable in response to receiving a bolt disposed on the door. Briefly, when the door is moved toward a closed position, a leading edge of the bolt contacts or otherwise slideably engages and lifts the lock plate to align the bolt with an opening on the lock plate. Once aligned, continued movement of the door causes the bolt to travel through the opening a sufficient distance until a trailing edge of the bolt is fully inserted through the lock plate. This enables the lock plate to return a lower position for securing the door in a closed position.

BRIEF DESCRIPTION OF THE DRAWINGS

For a more complete understanding of the present invention, including additional features, objects and advantages thereof, reference is now made to the following detailed description taken in conjunction with the drawings, in which.

DETAILED DESCRIPTION OF THE DRAWINGS

Figure 1:
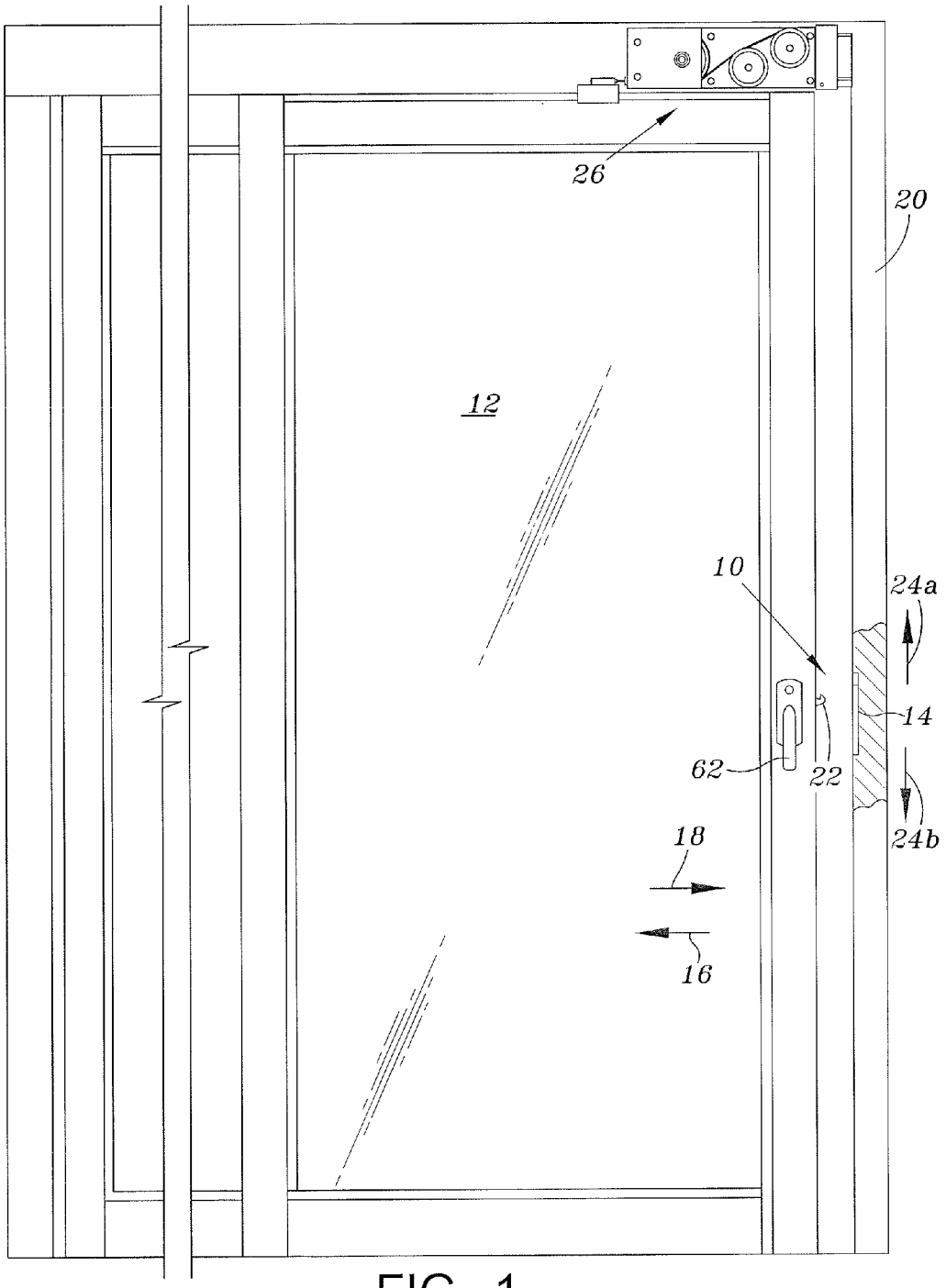
FIG. 1 is an illustration of a sliding door having a latch assembly employing a movable lock plate therein.

In the description which follows, like parts are marked throughout the specification and drawings with the same reference numerals, respectively. The drawings may not be to scale and certain features may be shown exaggerated in scale or in somewhat schematic form in the interest of clarity and conciseness.

Referring to FIG. 1, a door latch assembly 10 is illustrated employing a movable lock plate 14 to facilitate smooth and quiet closing of a door 12 with reduced or minimal door closing force acting on door 12. Lock plate 14 is slideably movable on a door jamb 20 and is positioned to receive a bolt 22 extending from door 12. In operation, as door 12 approaches the closed position, bolt 22 slideably engages lock plate 14 to lift lock plate 14 in the direction of arrow 24*a* to align with and receive bolt 22. In FIG. 1, sliding door 12 is a self-closing type sliding door such that as door 12 is moved in the direction of arrow 16, a closing device 26 stores potential energy to move door 12 in the direction of arrow 18 until door 12 reaches the closed position. While FIG. 1 illustrates a sliding door 12, it should be understood that other types of doors, such as, for example, a swinging door, can incorporate latch assembly 10 in order to facilitate the smooth and thus quiet closure of door 12 and further, other types of closing devices, either automated or manual operated, may be utilized.

Figure 2:
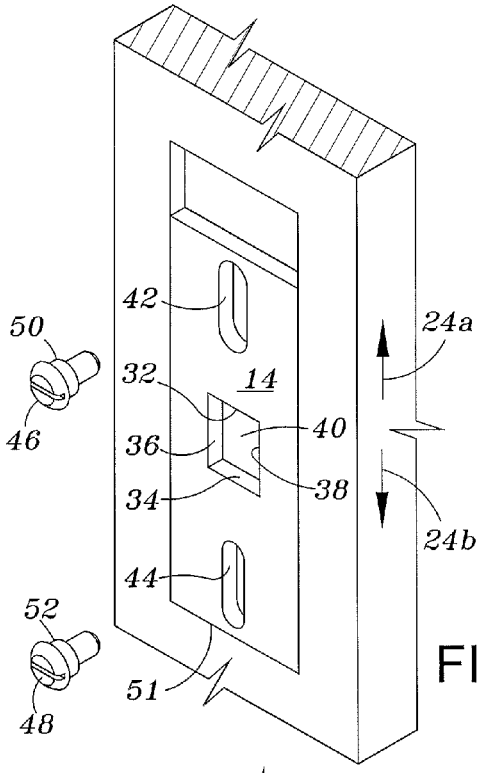
FIG. 2 is perspective view of the movable lock plate of FIG. 1.

Referring now to FIG. 2, lock plate 14 is disposed on door jamb 20 and movable in the direction of arrow 24*a* from a lower position (FIG. 2) to an upper position (FIG. 4) to receive bolt 22 as door 12 approaches the closed position. Lock plate 14 includes a central opening 40 defined by a top edge 32, a bottom edge 34, and side edges 36 and 38 and is sized to receive bolt 22. Lock plate 14 further includes slots 42 and 44 disposed above and below opening 40, respectively to receive fasteners 46 and 48, respectively. Preferably, fasteners 46 and 48 are screws that are used to attach lock plate 14 to door jamb 20 (FIG. 1). Fasteners 46 and 48 are tightened a sufficient amount to secure lock plate 14 to jamb 20 but loose enough, as explained in further detail below, to enable movement of lock plate 14 relative to jamb 20. In FIG. 2, fasteners 46 and 48 each have a diameter slightly less than the width of slots 42 and 44, which enable sliding movement of lock plate 14. Fasteners 46 and 48 can optionally include sleeves 50 and 52 disposed respectively therearound to reduce the frictional contact with the sidewalls of slots 42 and 44 to allow for ease of movement of lock plate 14. It should be understood, however, that movable lock plate 14 can be otherwise mounted on jamb 20. For example, in lieu of fasteners 46 and 48, lock plate 14 can be mounted within a track or slot (not illustrated) disposed on door jamb 20 to enable sliding movement in the direction of arrows 24*a* and 24*b*. Furthermore, in the embodiment illustrated in FIGS. 1-5, lock plate 14 is slideably movable within a recess formed in door frame 20; however, it should be understood that lock plate 14 may be otherwise positioned over the surface of door jamb 20.

Figure 3:
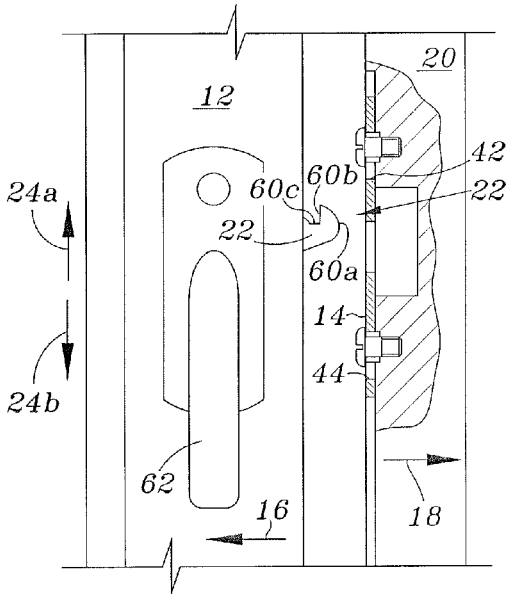
FIGS. 3 and 4 are detail views of the sliding door of FIG. 1 in which the door is spaced apart from the door jamb.
Figure 4:
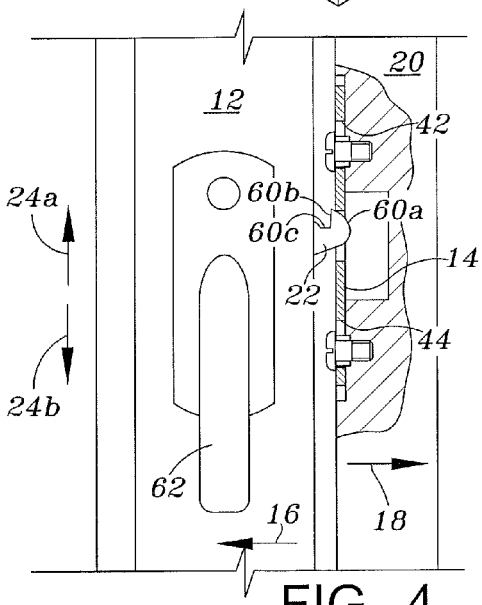
Figure 5:
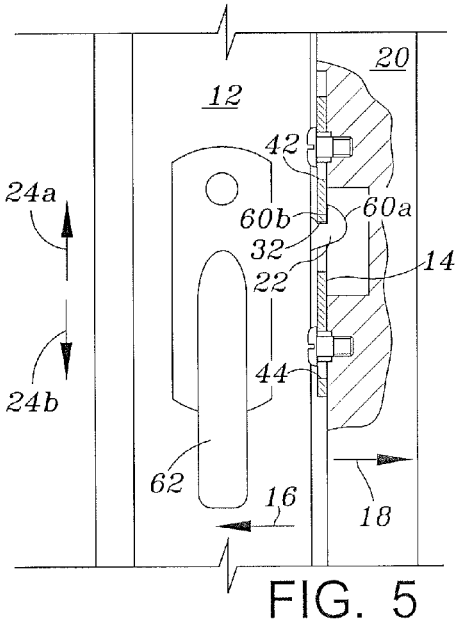
FIG. 5 is a detail view of a portion of door latch assembly of FIG. 1 in which the door is in the fully closed position.

Operation of door latch assembly 10 is illustrated in FIGS. 3-5. Referring specifically to FIG. 3, as door 12 is spaced apart from jamb 20, lock plate 14 positioned in the lower position. Continued movement of door 12 in the direction of arrow 18 (FIGS. 3 and 4) causes bolt 22 to contact lock plate 14. In particular, bolt 22 includes a sloped leading edge 60*a*, a trailing edge 60*b*, and a recess 60*c*. During door movement, leading edge 60*a* slideably engages lock plate 14 to lift or otherwise raise lock plate 14 in the direction of arrow 24*a*. Continued movement of door 12, and thus bolt 22, causes bolt 22 to continue to lift lock plate 14 to enable bolt 22 to fit through opening 40. As seen in FIG. 5, once trailing edge 60*b* passes through opening 40, door 12 is fully closed and seated against door jamb 20. As such, lock plate 14 drops/slides downward in the direction of arrow 24*b* until top edge 32 is disposed within recess 60*c* of bolt 22 so as to prevent the removal of bolt 22 from opening 40, and thus, the unintended opening of door 12 in the direction of arrow 16. When opening door 12, a handle 62 is actuated or otherwise moved to rotate bolt 22 downward in the general direction of arrow 24*b* in an unlocked position such that the entire bolt 22 is aligned with opening 40 on latch plate 14. Once aligned therewith, door 12 can be moved in the direction of arrow 16 towards the open position. Once the handle 62 is released, bolt 22 travels upward in the direction of arrow 24*a* to return to a locked position (FIG. 3).

Although specific embodiments have been described in detail, those skilled in the art will also recognize that various substitutions and modifications may be made without departing from the scope and spirit of the appended claims.

What is claimed is:

1. A latch assembly for a sliding door movable between an open position and a closed position, the latch assembly comprising:

a bolt having a sloped leading edge and a trailing edge, the bolt extending through a wall of the door and movable between a locked position, to secure the door in the closed position, and an unlocked position, to enable movement of the door from the closed position to the open position;

a lock plate disposed on a door jamb wall, the lock plate having a front and a back surfaces and a hole extending through the lock plate between the front and the back surfaces, the lock plate longitudinally slidable along the door jamb wall between a first position and a second position wherein the bolt, when in the locked position, slideably engages the lock plate at the sloped leading edge as the door is moved toward the closed position to move the lock plate from the first position to the second position to enable the bolt to be inserted within the through hole;

wherein the lock plate moves to a third position in response to the trailing edge passing through the opening, the trailing edge oriented in a plane parallel to the plane of the lock plate when the bolt is in the locked position to lock the door in the closed position; and wherein the bolt moves to the unlocked position to align the trailing edge with the opening while the lock plate remains stationary to facilitate movement of the door from the closed position toward the open position.

2. The latch assembly of claim 1, wherein the lock plate comprises a slot to receive a fastener for securing the lock plate to a door jamb, wherein the lock plate is movable relative to the fastener.

3. The latch assembly of claim 2, wherein the fastener comprises a screw having an outer sleeve to reduce frictional contact between the lock plate and the fastener when the lock plate moves.

4. The latch assembly of claim 1, wherein the bolt comprises a hook to engage the lock plate.

5. The latch assembly of claim 1, wherein the bolt is movable to the unlocked position to disengage from the lock plate.

6. The latch assembly of claim 1, wherein the door is a sliding door.

7. A latch assembly for a door, comprising:

a bolt disposed within the door and extending from a wall of the door and moveable between a locked position and an unlocked position, the bolt having a sloped leading edge and a trailing edge;

a lock plate disposed on a wall of a door jamb, the door jamb wall facing the wall of the door, the lock plate having a front and a back surfaces and a hole extending through the lock plate between the front and the back surfaces, the hole to receive the bolt when the bolt is in the locked position, the lock plate longitudinally slidable along the door jamb wall and lifted by the sloped leading edge of the bolt from a first position to a second position in response to sliding contact between the sloped leading edge and the through hole as the door is moved toward a closed position, and the lock plate, after passing the sloped leading edge and the trailing edge, moves from the second position to a third position by gravity such that the trailing edge is in a plane parallel and adjacent to a plane that the lock plate is disposed in, for securing the door in a closed position; and the bolt is moved to the unlocked position by aligning the trailing edge of the bolt with the through hole while the lock plate remains stationary to unlock the door from the closed position.

8. The latch assembly of claim 7, wherein the lock plate comprises a slot to receive a fastener for securing the lock plate to the door jamb, wherein the lock plate is movable relative to the fastener.

9. The latch assembly of claim 8, wherein the fastener comprises a screw having an outer sleeve to reduce frictional contact between the lock plate and the fastener when the lock plate moves.

10. The latch assembly of claim 7, wherein the bolt comprises a hook to engage the lock plate.

11. The latch assembly of claim 7, wherein the third position is different from the first and second positions.

12. The latch assembly of claim 11, wherein the bolt is movable to the unlocked position in response to movement of a handle.

13. The latch assembly of claim 8, wherein the door is a sliding door.

14. The latch assembly of claim 1, wherein the first position and the third position are the same.

* * * * *